US005994013A

United States Patent [19]

Levin et al.

[11] Patent Number: 5,994,013

[45] Date of Patent: Nov. 30, 1999

[54] DUAL LAYER PHOTOCONDUCTORS WITH CHARGE GENERATION LAYER CONTAINING CHARGE TRANSPORT COMPOUND

[75] Inventors: Ronald Harold Levin; Scott Thomas Mosier, both of Boulder; Jennifer Kaye Neely, Arvada; Catherine Mailhé Randolph, Niwot, all of Colo.

[73] Assignee: Lexmark International, Inc., Lexington, Ky.

[21] Appl. No.: 09/066,284

[22] Filed: Apr. 24, 1998

[51] Int. Cl.[6] ..... G03G 5/043

[52] U.S. Cl. ..... 430/58.4; 430/59.4

[58] Field of Search ..... 430/58, 59, 58.4, 430/59.4

[56] References Cited

U.S. PATENT DOCUMENTS

| | | | |
|---|---|---|---|
| 4,490,452 | 12/1984 | Champ et al. | 430/59 |
| 4,565,758 | 1/1986 | Tachiki et al. | 430/58 |
| 4,882,253 | 11/1989 | Kato et al. | 430/59 |
| 4,889,784 | 12/1989 | Champ et al. | 430/58 |
| 4,921,773 | 5/1990 | Melnyk et al. | 430/58 |
| 4,933,244 | 6/1990 | Teuscher et al. | 430/58 |
| 4,968,579 | 11/1990 | Kimoto et al. | 430/134 |
| 5,130,215 | 7/1992 | Adley et al. | 430/58 |
| 5,164,276 | 11/1992 | Robinson et al. | 430/59 |
| 5,244,760 | 9/1993 | Nealey et al. | 430/58 |
| 5,306,587 | 4/1994 | Terrell et al. | 430/58 |
| 5,310,613 | 5/1994 | Pai et al. | 430/59 |
| 5,328,788 | 7/1994 | Omote et al. | 430/57 |
| 5,389,477 | 2/1995 | Tsuchiya et al. | 430/57 |
| 5,413,886 | 5/1995 | Pai et al. | 430/59 |
| 5,476,604 | 12/1995 | Nguyen | 252/62.3 |
| 5,486,438 | 1/1996 | Shoshi et al. | 430/58 |
| 5,500,718 | 3/1996 | Hashimoto et al. | 355/210 |
| 5,521,039 | 5/1996 | Hoshi et al. | 430/49 |
| 5,545,499 | 8/1996 | Balthis et al. | 430/59 |
| 5,556,730 | 9/1996 | Nguyen | 430/66 |
| 5,677,094 | 10/1997 | Umeda et al. | 430/58 |
| 5,677,097 | 10/1997 | Nukada et al. | 430/59 |
| 5,681,677 | 10/1997 | Bugner et al. | 430/58 |

*Primary Examiner*—John Goodrow
*Attorney, Agent, or Firm*—John A. Brady

[57] ABSTRACT

Photoconductors comprise a substrate, a charge transport layer and a charge generation layer, wherein the charge transport layer comprises binder and a first charge transport compound and the charge generation layer comprises binder, a charge generation compound and a second charge transport compound. The first and second charge transport compounds may be the same or different. In a first embodiment, the second charge transport compound is effective as a dopant in the charge generation layer and the weight ratio of the charge generation compound to the second charge transport compound in the charge generation layer is not less than about 1:3. In a second embodiment, the charge generation layer is formed on the substrate and the charge transport layer is formed on the charge generation layer. In a third embodiment, the charge generation layer comprises at least about 15 weight percent, based on the weight of the charge generation layer, of the charge generation compound.

22 Claims, 7 Drawing Sheets

1000
800
600
400
200
0
VOLTAGE (−V)
L
M
K
0
0.2
0.4
0.6
0.8
1
1.2
ENERGY (μJ/cm²)

800
600
400
200
0
VOLTAGE (−V)
L
M
K
0
0.5
1
1.5
2
ENERGY (μJ/cm²)

DUAL LAYER PHOTOCONDUCTORS WITH CHARGE GENERATION LAYER CONTAINING CHARGE TRANSPORT COMPOUND

FIELD OF THE INVENTION

The present invention is directed to dual layer photoconductors which comprise a charge transport layer and a charge generation layer formed on a substrate. More particularly, the invention is directed to such dual layer photoconductors wherein the charge generation layer includes a charge transport compound.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

Generally, when the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises a polymeric binder containing a charge generation compound or molecule while the charge transport layer comprises a polymeric binder containing the charge transport compound or molecule. The charge generation compounds within the CGL are sensitive to image-forming radiation and photogenerate electron-hole pairs within the CGL as a result of absorbing such radiation. The CTL is usually non-absorbent of the image-forming radiation and the charge transport compounds serve to transport holes to the surface of a negatively charged photoconductor. Photoconductors of th is type are disclosed in the Adley et al U.S. Pat. No. 5,130,215 and the Balthis et al U.S. Pat. No. 5,545,499.

Generally, by increasing the content of the charge transport compound in the charge transport layer, faster imaging speeds and reduced residual voltages may be obtained. However, when the amount of the charge transport compound in the charge transport layer is increased above about 40 to 50 weight percent, based on the weight of the charge transport layer, the mechanical properties of the photoconductor often begin to suffer and increased wear rates and reduced mechanical strength result. Several references have disclosed the use of certain amounts of specific charge transport compounds or the use of a charge transport polymer in charge generation layers, for example in the Champ et al U.S. Pat. No. 4,490,452, the Kato et al U.S. Pat. No. 4,882,253 and the Umeda et al U.S. Pat. No. 5,677,094. However, as photoconductors of improved sensitivity and durability and improved performance over extended photoconductor life are continually desired, particularly at lower cost, there is a continuing need for the development of new materials to meet these demands.

SUMMARY OF THE INVENTION

Accordingly, it is an object of the present invention to provide photoconductors which exhibit improved properties and/or performance. More particularly, it is an object of the present invention to provide dual layer photoconductors which exhibit improved electrical performance, for example improved sensitivity and/or improved residual voltage properties. It is yet a further object of the invention to provide dual layer photoconductors which exhibit improved dark decay, i.e., a reduced loss of charge from the surface of the photoconductor when it is maintained in the dark.

These and additional objects and advantages are provided by the dual layer photoconductors according to the present invention in which the charge generation layer includes a charge transport compound. Generally, the photoconductors according to the present invention comprise a substrate, a charge generation layer and a charge transport layer, wherein the charge transport layer comprises binder and a first charge transport compound and the charge generation layer comprises binder, a charge generation compound and a second charge transport compound. The first and second charge transport compounds may be the same or different. In a first embodiment, the second charge transport compound is present as a dopant in the charge generation layer and the weight ratio of the charge generation compound to the second charge transport compound in the charge generation layer is not less than about 1:3. In a second embodiment, the charge generation layer is formed on the substrate and the charge transport layer is formed on the charge generation layer. In a further embodiment, the charge generation layer comprises at least about 15 weight percent, based on the weight of the charge generation layer, of the charge generation compound.

The dual layer photoconductors according to the present invention are advantageous in that they exhibit good electrical performance, including good sensitivity and/or good residual voltage. The photoconductors according to the present invention are further advantageous in that they exhibit a noticeable reduction in dark decay as compared with conventional photoconductors wherein the charge generation layer does not contain a charge transport compound. Additionally, the present photoconductors are advantageous in that they exhibit good mechanical properties and avoid the increased wear rates and reduced mechanical strength which may be incurred when charge transport compounds are included in amounts greater than about 40 weight percent in the charge transport layer.

These and additional objects and advantages will be further apparent in view of the following detailed description.

BRIEF DESCRIPTION OF THE DRAWING

The present invention as set forth in the detailed description will be more fully understood when viewed in connection with the drawing in which.

DETAILED DESCRIPTION

Figure 1:
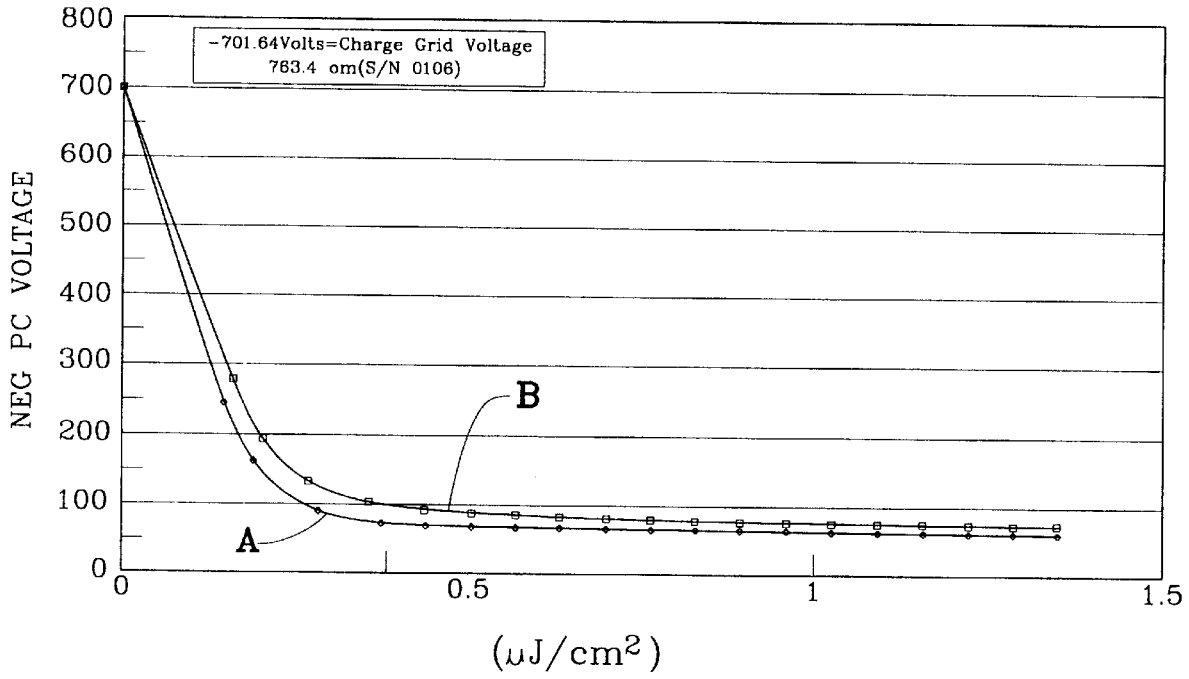
FIG. 1 sets forth electrical performance properties of a photoconductor A according to the present invention wherein the charge generation layer includes a charge transport compound and electrical performance properties of a conventional photoconductor B wherein the charge generation layer is free of charge transport compound, as described in Example 1.

The dual layer photoconductors according to the present invention comprise a substrate, a charge transport layer and a charge generation layer, wherein the charge transport layer comprises binder and a first charge transport compound and the charge generation layer comprises binder, a charge generation compound and a second charge transport compound. The first and second charge transport compounds may be the same or different. Preferably, the second charge transport compound is present as a dopant in the charge generation layer.

The photoconductor substrate may be flexible, for example in the form of a flexible web or a belt, or inflexible, for example in the form of a drum. Typically, the photoconductor substrate is uniformly coated with a thin layer if a metal, preferably aluminum, which functions as an electrical ground plane. In a further preferred embodiment, the aluminum is anodized to convert the aluminum surface into a thicker aluminum oxide surface. Alternatively, the ground plane member may comprise a metallic plate, such as aluminum or nickel, a metallic drum or foil, or a plastic film on which aluminum, tin oxide or indium oxide or the like is vacuum evaporated.

In a preferred embodiment, the charge generation layer may be formed on the photoconductor substrate, followed by formation of the charge transport layer containing a hole transport compound, whereby a negative charge may be placed on the photoconductor surface. Conversely, the charge transport layer containing a hole transport compound may be formed on the photoconductor substrate and the charge generation layer is in turn formed on the charge transport layer, whereby a positive charge may be placed on the photoconductor surface. On the other hand, as one skilled in the art will appreciate, if the charge transport layer contains an electron transport material, the charges which may be placed on the photoconductor surface as a result of the arrangement of the charge transport and charge generation layers will be reversed.

The charge transport layer included in the dual layer photoconductors according to the present invention comprises binder and a first charge transport compound. The charge transport layer is in accordance with conventional practices in the art and therefore may include any binder and any charge transport compound generally known in the art for use in charge transport layers. Typically, the binder is polymeric and may comprise, but is not limited to, vinyl polymers such as polyvinyl chloride, polyvinyl butyral, polyvinyl acetate, styrene polymer, and copolymers of these vinyl polymers, acrylic acid and acrylate polymers and copolymers, polycarbonate polymers and copolymers, including polyestercarbonates, polyesters, alkyd resins, polyamides, polyurethanes, epoxy resins and the like. Preferably, the polymeric binder of the charge transport layer is inactive, i.e., it does not exhibit charge transporting properties.

Conventional charge transport compounds suitable for use in the charge transport layer of the photoconductors of the present invention should be capable of supporting the injection of photo-generated holes or electrons from the charge generation layer and allowing the transport of these holes or electrons through the charge transport layer to selectively discharge the surface charge. Suitable charge transport compounds for use in the charge transport layer include, but are not limited to, the following:

1. Diamine transport molecules of the types described in U.S. Pat. Nos. 4,306,008, 4,304,829, 4,233,384, 4,115,116, 4,299,897, 4,265,990 and/or 4,081,274. Typical diamine transport molecules include N,N'-diphenyl-N,N'-bis (alkylphenyl)-[1,1'-biphenyl]-4,4'-diamines wherein the alkyl is, for example, methyl, ethyl, propyl, n-butyl, or the like, or halogen substituted derivatives thereof, and the like.

2. Pyrazoline transport molecules as disclosed in U.S. Pat. Nos. 4,315,982, 4,278,746 and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-diethylaminostyryl]-5-(p-dimethylaminostyryl)pyrazoline, 1-phenyl-3-[p-diethylaminostyryl]-5-(p-diethylaminostyryl) pyrazoline, and the like.

3. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like.

4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

5. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such a 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Preferably, the charge transport compound included in the charge transport layer comprises a hydrazone, an aromatic amine (including aromatic diamines), a substituted aromatic amine (including substituted aromatic diamines), or a mixture thereof. Preferred hydrazone transport molecules include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, respectively, all of which patents and applications are incorporated herein by reference.

The charge transport layer typically comprises the charge transport compound in an amount of from about 5 to about 60 weight percent, based on the weight of the charge transport layer, and more preferably in an amount of from about 15 to about 40 weight percent, based on the weight of the charge transport layer, with the remainder of the charge transport layer comprising the binder, and any conventional additives.

As set forth above, the charge generation layer comprises binder, a charge generation compound and a charge transport compound. The polymeric binder of the charge generation layer may be any polymeric binder known in the art for use in charge generation layers. Preferably, the binder of the charge generation layer is inactive, i.e, it does not exhibit either charge generation or charge transporting properties, and may comprise any of the binders noted above for use in the charge transport layer. Preferably, the charge generation layer comprises the binder in an amount of from about 10 to about 90 weight percent and more preferably in an amount of from about 20 to about 75 weight percent, based on the weight of the charge generation layer.

Various charge generation compounds which are known in the art are suitable for use in the charge generation layer of the photoconductors according to the present invention. Organic charge generation compounds are suitable for use in the present photoconductors, examples of which include, but are not limited to, disazo compounds, for example as disclosed in the Ishikawa et al U.S. Pat. No. 4,413,045, tris and tetrakis compounds as known in the art, phthalocyanine dyes, including both metal-free forms such as X-form metal-free phthalocyanines and the metal-containing phthalocyanines such as titanium-containing phthalocyanines as disclosed in U.S. Pat. Nos. 4,664,997, 4,725,519 and 4,777,251, polymorphs and derivatives thereof, and squaric acid-derived dyes, for example hydroxy-squaraine charge generation compounds. In a preferred embodiment, the charge generation layer includes a phthalocyanine compound. Both metal-free forms and metal-containing forms of the phthalocyanines are preferred. A particularly preferred charge generation compound for use in the charge generation layer according to the present invention comprises metal-containing phthalocyanines, and more particularly metal-containing phthalocyanines wherein the metal is a transition metal or a group IIIA metal. Of these metal-containing phthalocyanine charge generation compounds, those containing a transition metal such as copper, titanium or manganese or containing aluminum as a group IIIA metal are preferred. It is further preferred that the metal-containing phthalocyanine charge generation compound is oxy, thiol or dihalo substituted. Oxo-titanyl phthalocyanines are especially preferred, including various polymorphs thereof, for example type IV polymorphs, and derivatives thereof, for example halogen-substituted derivatives such as chlorotitanyl phthalocyanines.

The charge generation compounds are employed in the charge generation layer in conventional amounts suitable for providing the charge generation effects. Suitably, the charge generation layer comprises at least about 5 weight percent, based on the weight of the charge generation layer, of the charge generation compound, and preferably at least about 10 weight percent, based on the weight of the charge generation layer. In further preferred embodiments, the charge generation layer comprises at least about 15 weight percent of the charge generation compound and preferably from about 15 to about 50 weight percent of the charge generation compound, based on the weight of the charge generation layer.

In accordance with an important feature of the present invention, the charge generation layer further comprises a charge transport compound. The charge transport compound of the charge generation layer may be the same as or different from the charge transport compound which is included in the charge transport layer. In the photoconductors of the present invention, the inclusion of the charge transport compound in the charge generation layer improves the electrical performance, for example, sensitivity and/or residual voltage, of the photoconductor, without incurring increased wear rates or reducing the mechanical strength of the photoconductor owing to high charge transport layer loadings. Additionally, the inclusion of the charge transport compound in the charge generation layer may provide the photoconductors of the present invention with significant reductions in dark decay phenomenon.

Typically, the charge transport compound in the charge generation layer acts as a dopant in the layer to provide these improvements.

The charge transport compound which is included in the charge generation layer may comprise any of the charge transport compounds conventionally known in the art, including, but not limited to, those discussed above for use in the charge transport layer. In a preferred embodiment, the charge transport compound included in the charge generation layer comprises a hydrazone compound, an aromatic amine (including aromatic diamines) or a substituted aromatic amine (including substituted aromatic diamines), or mixtures thereof.

Preferably, the second charge transport compound is included in the charge generation layer in an amount sufficient to provide a dopant effect. More preferably, the charge transport compound is included in the charge generation layer in an amount sufficient to improve one or more characteristics of the electrical performance of the photoconductor, for example to provide increased sensitivity and/or improved residual voltage, and/or to reduce dark decay charge losses of the photoconductors. In a preferred embodiment, the second charge transport compound is included in an amount of from about 10 to about 50 weight percent, based on the weight of the charge generation layer. In an additionally preferred embodiment, the weight ratio of the charge generation compound to the second charge transport compound contained in the charge generation layer is not less than about 1:3 and more preferably not less than about 1:2. Suitably, the weight ratio of the charge generation compound to the charge transport compound contained in the charge generator layer is from about 10:1 to about 1:3.

When the charge transport compound of the charge transport layer is different from the charge transport compound of the charge generation layer, it is preferred that the charge transport compound of the charge transport layer has an oxidation potential (commonly referred to as a redox potential $E_{redox}$) which is less than the oxidation potential of the charge transport compound of the charge generation layer or which is not more than about 0.2 V greater than the oxidation potential of the charge transport compound of the charge generation layer. This permits hole injection from the charge generation layer to the charge transport compound of the charge transport layer as required in an efficient device. More preferably, when the charge transport compound of the charge transport layer differs from the charge transport compound of the charge generation layer, the charge transport compound of the charge transport layer has an oxidation potential less than that of the charge transport compound of the charge generation layer.

Generally, when two or more charge transport compounds are mixed within a charge transport layer, significant trapping is exhibited if the charge transport compounds have substantially different oxidation potentials, typically greater than about 0.2 V. Accordingly, as is known in the art, for mixtures of charge transport compounds employed in a single charge transport layer, the compounds are selected such that their oxidation potentials do not differ by more than about 0.2 V and preferably do not differ by more than about 0.1 V. Because some amount of mixing is expected to occur at the interface of the charge generation layer and the charge transport layer in the photoconductors of the present invention, one would expect that a substantial similarity in the oxidation potentials of the respective charge transport compounds of the charge transport layer and the charge generation layer according to the present invention would be required. Surprisingly, it has been determined that photoconductors having good electrical performance may be obtained using different charge transport compounds in the charge transport layer and the charge generation layer, respectively, even when the oxidation potential of the charge transport compound in the charge generation layer is substantially greater than that of the charge transport compound in the charge transport layer. Photoconductors having good electrical performance may be obtained using different charge transport compounds in the charge transport layer and the charge generation layer, respectively, even when the oxidation potential of the charge transport compound in the charge generation layer is more than about 0.1 V greater or more than about 0.2 V greater than that of the charge transport compound in the charge transport layer.

The photoconductor imaging members described herein may be prepared according to conventional techniques. Typically, the photoconductor substrate will have a thickness adequate to provide the required mechanical stability. For example, flexible web substrates generally may have a thickness of from about 0.01 to about 0.1 microns, while drum substrates generally may have a thickness of from about 0.75 mm to about 1 mm. The charge generation layer will typically have a thickness of from about 0.05 to about 5.0 microns, and the charge transport layer will have a thickness of from about 10 to about 40 microns. In accordance with techniques known in the art, one or more barrier layers may be provided between the ground plane and the charge generation layer, typically having a thickness of from about 0.05 to about 20 microns. The respective charge generation layer and charge transport layer are formed by dispersing and/or dissolving the respective charge generation compound and/or the charge transport compound in a polymeric binder and solvent, coating the dispersion and/or solution on the respective underlying layer and drying the coating.

In a preferred embodiment, the charge generation layer is prepared in accordance with a two-step procedure, whereby further increases in the sensitivity of the photoconductor may be obtained. Typically, as discussed above, a charge generation dispersion is prepared by combining the charge generation compound, the polymeric binder and a solvent, and the dispersion is subjected to milling or grinding so that the charge generation compound is milled or ground in the presence of the binder and the solvent. In accordance with one embodiment of the present invention, it is preferred that the charge generation compound is first subjected to a premilling or premixing treatment in the presence of the charge transport compound and the solvent, in the absence of the polymeric binder. Thereafter, the binder is added to the dispersion of the charge generation compound and the charge transport compound in the solvent, and a milling treatment in the presence of the binder is conducted. The resulting charge generation dispersion, doped with the charge transport compound, may be used to form the charge generation layer of a photoconductor exhibiting improved sensitivity.

Although the present inventors do not intend to be bound by any one theory, it is believed that this two-step process permits a more efficient injection of charge from the charge transport compound to the photoexcited charge generation material in the resulting photoconductor. It is believed that the electron transfer involved in the injection step is sensitive to the distance between the molecules of the charge generation compound and the molecules of the charge transport compound, with short distances being preferred, and to the local concentration of charge transport compound molecules around the charge generation compound molecules, with higher concentrations being preferred. By premilling or premixing the charge generation compound in the presence of the charge transport compound, without the binder being present, it is believed that the concentration of charge transport compound molecules on or around the charge generation compound molecules may be increased and the distance between the charge generation compound molecules and the charge transport compound molecules may be decreased, and that the charge transport compound can adsorb directly to the surface of the charge generation compound without having to displace binder from the surface of the charge generation compound in the charge generation layer of the photoconductor.

Various embodiments of the photoconductors according to the present invention are illustrated in the following examples. In the examples and throughout the present specification, parts and percentages are by weight unless otherwise specified.

EXAMPLE 1

In this example, a photoconductor according to the present invention and a conventional photoconductor were prepared. In each photoconductor, a charge generation layer was dip-coated on an anodized aluminum substrate and a charge transport layer was dip-coated on the charge generation layer. The charge transport layer of each photoconductor comprised about 60 weight percent of a polymer binder and about 40 weight percent of a charge transport compound comprising N,N'-bis-(3-methylphenyl)-N,N'-bis-phenylbenzidine (TPD) of the formula:

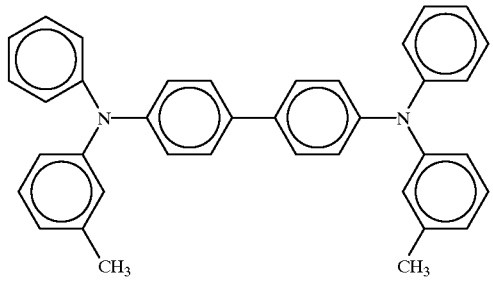

The charge generation layer of the photoconductor according to the invention, photoconductor A, comprised about 28 weight percent oxo-titanyl phthalocyanine (TiOpc) Type IV pigment, about 35 weight percent binder and about 37 weight percent of TPD as the charge transport compound. The charge generation layer of the conventional photoconductor, photoconductor B, was free of charge transport compound and comprised about 45 weight percent oxo-titanyl phthalocyanine pigment and about 55 weight percent binder, and therefore contained the same pigment to binder weight ratio as photoconductor A.

The photoconductors of this example were subject to sensitivity measurements using a sensitometer fitted with electrostatic probes to measure the voltage magnitude as a function of light energy shining on the photoconductor surface. The sensitometer included a charging source designed to charge the photoconductor to about −700 V. The photosensitivity is indicated by the photoconductor's residual voltage from its initial charge of about −700 V versus the amount of light energy, in micro joules/cm$^2$. The results of these measurements are set forth in FIG. 1. Surprisingly, photoconductor A (curve A in FIG. 1) exhibited improved sensitivity and residual voltage as compared with photoconductor B (curve B in FIG. 1). As is known in the art, sensitivity is measured as the reciprocal of the energy required to discharge a photoconductor from an initial potential, $V_o$, to an arbitrary potentials typically $V_o/2$. Accordingly, the improved sensitivity of photoconductor A is demonstrated by the sharper slope of curve A as compared with Curve B in the low energy region.

Figure 2:
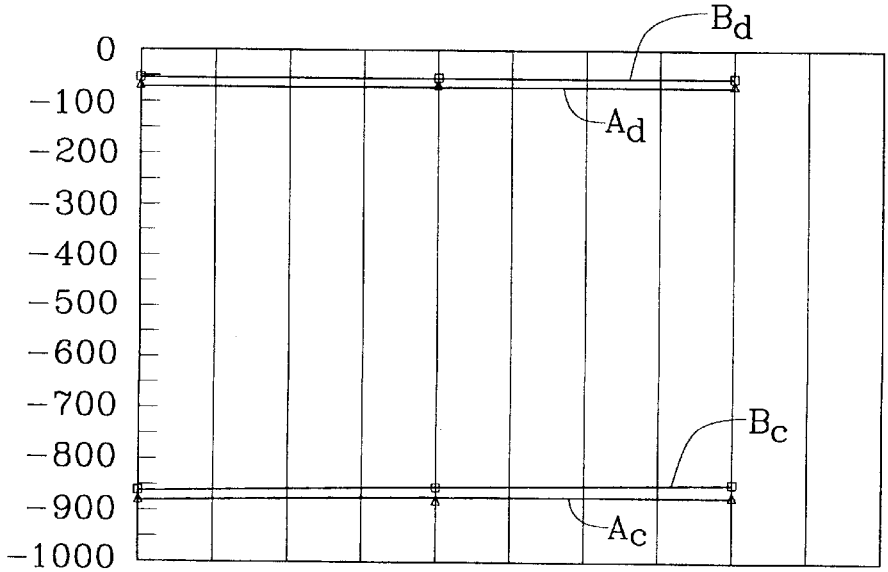
FIG. 2 sets forth cycling fatigue measurements of the photoconductor A according to the present invention wherein the charge generation layer includes a charge transport compound and cycling fatigue measurements of the conventional photoconductor B wherein the charge generation layer is free of charge transport compound, as described in Example 1.
Figure 3:
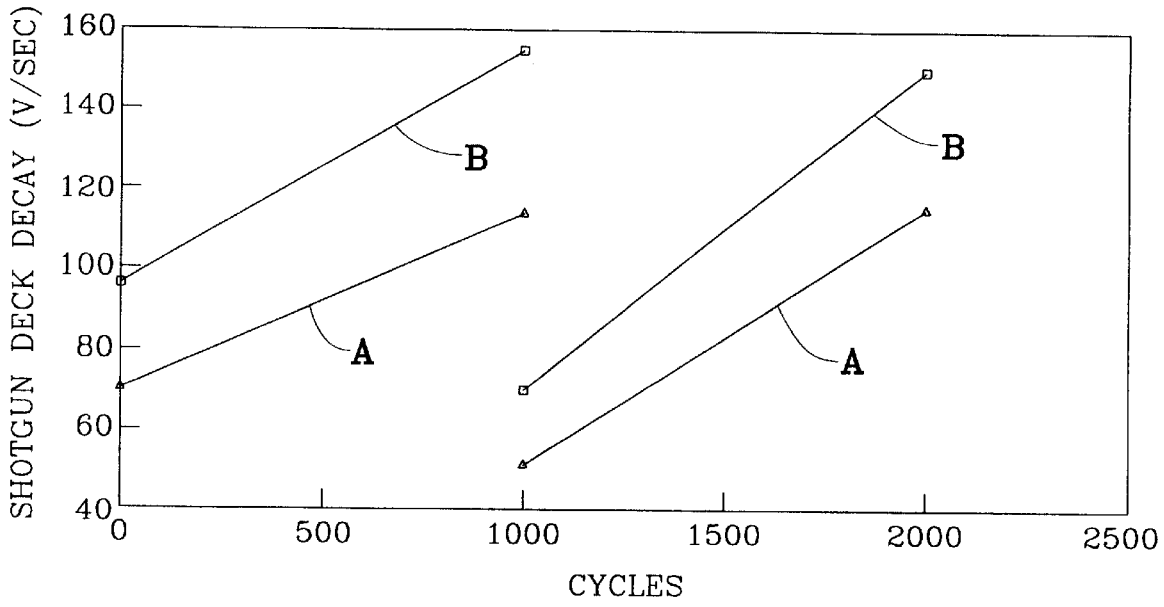
FIG. 3 sets forth dark decay properties exhibited by the photoconductor A according to the present invention wherein the charge generation layer includes a charge transport compound and dark decay properties exhibited by the conventional photoconductor B wherein the charge generation layer is free of charge transport compound, as described in Example 1.

The photoconductors of this example were also subjected to measurement of cycling fatigue by measurement of the change in $V_{charge}$ and $V_{discharge}$ over a number of imaging cycles. The results of these measurements are set forth in FIG. 2. The results in FIG. 2 demonstrate that the cycling fatigues of photoconductor A as represented by curves Ac ($V_{charge}$) and Ad ($V_{discharge}$) were not adversely affected by the incorporation of the charge transport compound in the charge generation layer as compared with the cycling fatigues of photoconductor B as represented by curves Bc ($V_{charge}$) and Bd ($V_{discharge}$), The photoconductors of this example were also subjected to measurement of dark decay properties, both initially and upon cycling, and the results are set forth in FIG. 3. Dark decay is the loss of charge from the surface of the photoconductor when it is maintained in the dark. Dark decay is an undesirable feature as it reduces the contrast potential between image and background areas, leading to washed out images and loss of gray scale. Dark decay also reduces the field that the photoconductive process will experience when light is brought back to the surface, thereby reducing the operational efficiency of the photoconductor. The results set forth in FIG. 3 demonstrate that both initial and cycling dark decay are significantly reduced in photoconductor A according to the present invention (curves A) as compared with the conventional photoconductor B (curves B).

EXAMPLE 2

In this example, a photoconductor according to the present invention and a conventional photoconductor were prepared. In each photoconductor, a charge generation layer was dip-coated on an anodized aluminum substrate and a charge transport layer was dip-coated on the charge generation layer. The charge transport layer of each photoconductor comprised about 60 weight percent of a polymer binder and about 40 weight percent of a charge transport compound comprising tritolylamine (TTA) of the formula:

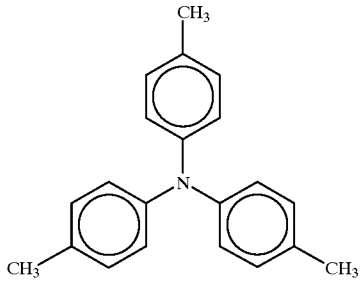

The charge generation layer of the photoconductor according to the invention, photoconductor C, comprised about 28 weight percent oxo-titanyl phthalocyanine pigment, about 35 weight percent binder and about 37 weight percent of TPD as described in Example 1 as the charge transport compound. Thus, the charge generation layer and the charge transport layer contained different charge transport compounds. The charge generation layer of the conventional photoconductor, photoconductor D, was free of charge transport compound and comprised about 45 weight percent oxo-titanyl phthalocyanine pigment and about 55 weight percent binder, and therefore contained the same pigment to binder weight ratio as photoconductor C.

Figure 4:
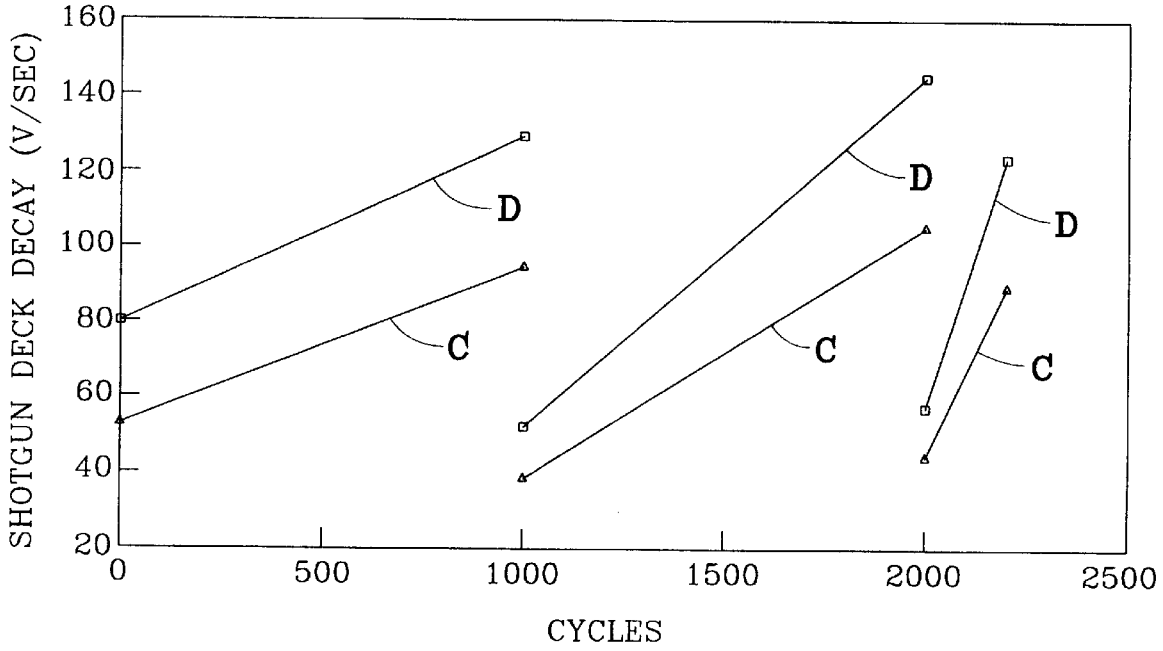
FIG. 4 sets forth dark decay properties exhibited by a photoconductor C according to the present invention wherein the charge generation layer includes a charge transport compound and dark decay properties exhibited by a conventional photoconductor D wherein the charge generation layer is free of charge transport compound, as described in Example 2.

The photoconductors of this example were subjected to measurement of dark decay properties, both initially and upon cycling, and the results are set forth in FIG. 4. The results in FIG. 4 demonstrate that both initial and cycling dark decay are significantly reduced in photoconductor C according to the present invention (curves C) as compared with the conventional photoconductor D (curves D).

EXAMPLE 3

In this example, three photoconductors according to the present invention, E, F and G, and three conventional photoconductors, H, I and J, were prepared. In each photoconductor, a charge generation layer was dip-coated on an anodized aluminum substrate and a charge transport layer was dip-coated on the charge generation layer. The charge transport layer of each photoconductor comprised about 60 weight percent of a polymer binder and about 40 weight percent of a charge transport compound comprising 4-N,N-diethylaminobenzaldehyde-N',N'-diphenylhydrazone (DEH) of the formula:

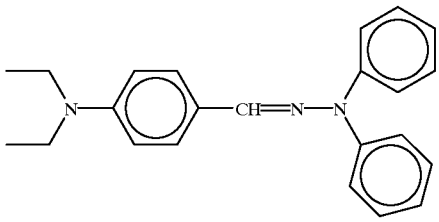

DEH has an oxidation potential of about 0.53 V.

The charge generation layer of the photoconductor E according to the invention comprised about 45 weight percent oxo-titanyl phthalocyanine pigment, about 35 weight percent binder and about 20 weight percent of TPD as described in Example 1 as the charge transport compound. TPD has an oxidation potential of about 0.73 V. The charge generation layer of the comparative conventional photoconductor H was free of charge transport compound and comprised about 45 weight percent oxo-titanyl phthalocyanine pigment and about 55 weight percent binder, and therefore contained the same amount of pigment as photoconductor E.

The charge generation layer of the photoconductor F according to the invention comprised about 45 weight percent oxo-titanyl phthalocyanine pigment, about 35 weight percent binder and about 20 weight percent of the charge transport compound 9-ethylcarbazole-3-aldehyde-N,N-diphenylhydrazone (CzDEH) of the formula:

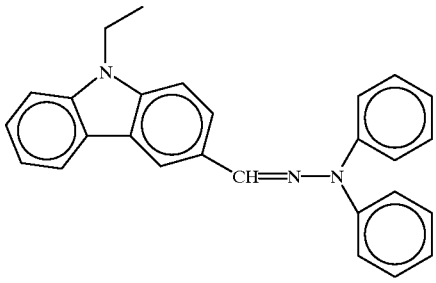

CzDEH has an oxidation potential of about 0.81 V. The charge generation layer of the comparative conventional photoconductor I was free of charge transport compound and comprised about 45 weight percent oxo-titanyl phthalocyanine pigment and about 55 weight percent binder, and therefore contained the same amount of pigment as photoconductor F.

The charge generation layer of the photoconductor G according to the invention comprised about 45 weight percent oxo-titanyl phthalocyanine pigment, about 35 weight percent binder and about 20 weight percent of the charge transport compound 4-N,N-diphenylaminobenzaldehyde-N',N'-diphenylhydrazone (TPH) of the formula:

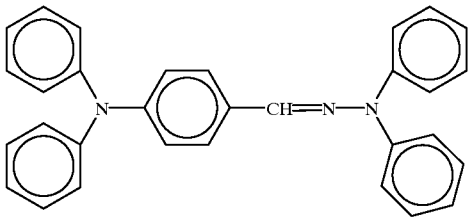

TPH has an oxidation potential of about 0.73. The charge generation layer of the comparative conventional photoconductor J was free of charge transport compound and comprised about 56 weight percent oxo-titanyl phthalocyanine pigment and about 44 weight percent binder, and therefore contained the same weight ratio of pigment to binder as photoconductor G.

Figure 5A:
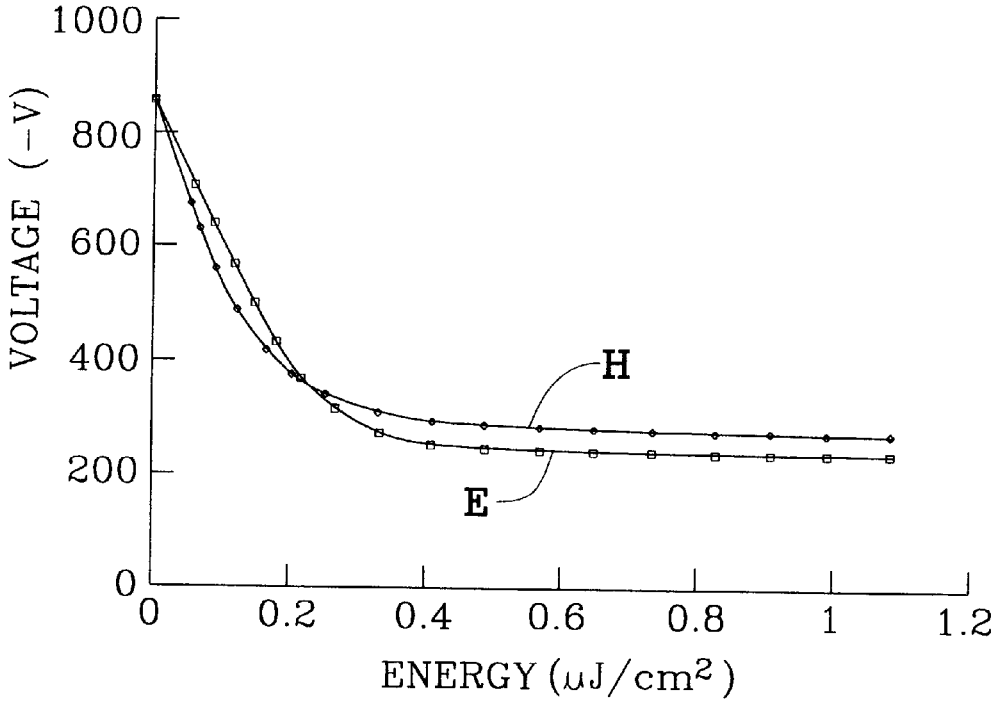
FIGS. 5A–5C, respectively, set forth electrical performance properties of three photoconductors E, F and G according to the present invention wherein the charge generation layers contain a charge transport compound and the electrical performance properties of three conventional photoconductors H, I and J wherein the charge generation layers are free of charge transport compound, as described in Example 3.
Figure 5B:
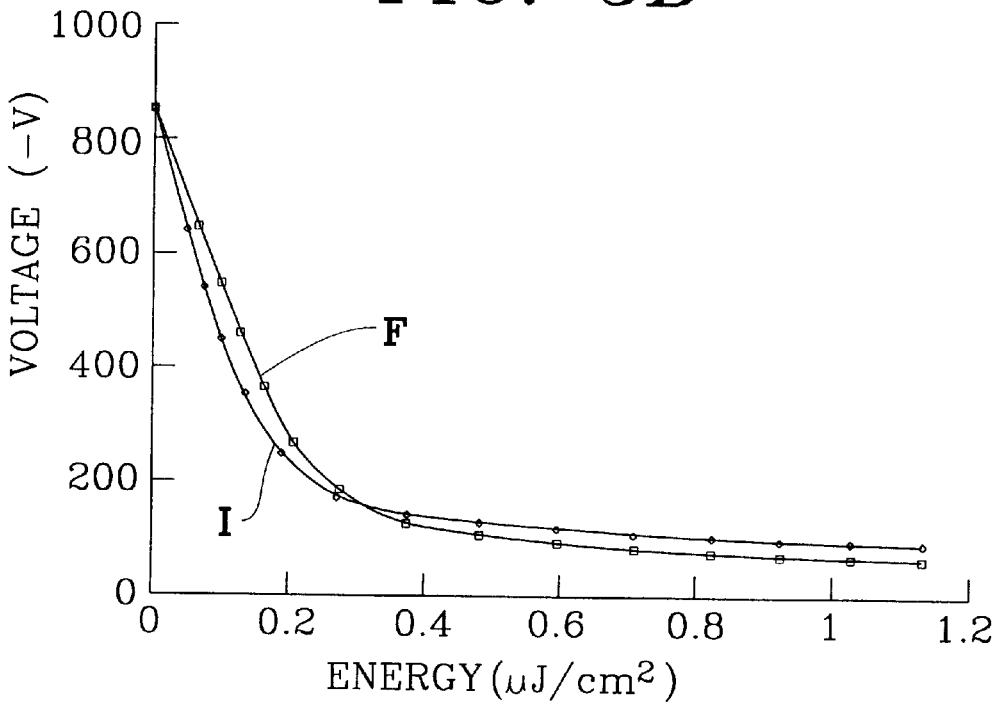
Figure 5C:
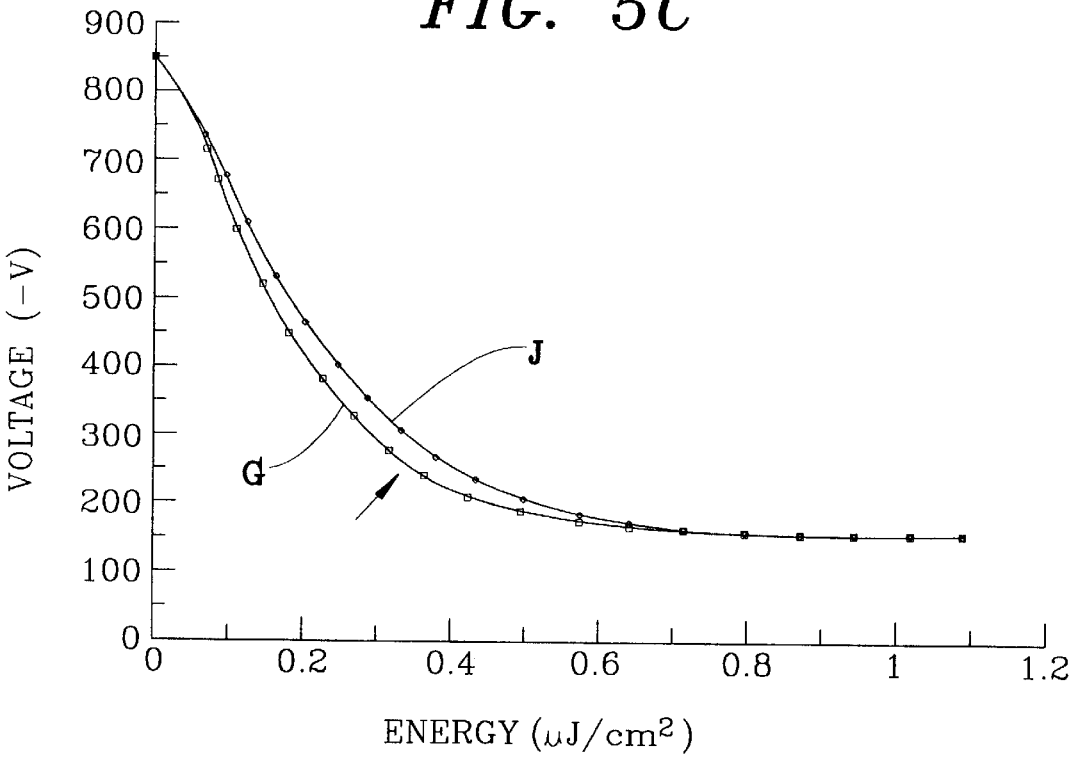

The photoconductors of this example were subjected to sensitivity measurements using a sensitometer as described in Example 1 with a charging source designed to charge the photoconductor to about −850 V. The results of these measurements for photoconductors E and H, F and I, and G and J, respectively, are set forth by curves E and H, curves F and I, and curves G and J in FIGS. 5A–5C. Since the difference in oxidation potentials between the charge transport compound in the charge generation layer and the charge transport compound in the charge transport layer for each of photoconductors E, F and G is at least about 0.2 V, one might expect the photoconductors to exhibit significant trapping and a deterioration of electrical properties owing to mixing at the interface between the charge generation layer and the charge transport layer of each photoconductor. Surprisingly, deterioration of the electrical properties was not observed in the photoconductor; according to the invention as demonstrated in FIGS. 5A–5C. In fact, photoconductor E exhibited a noticeable decrease in residual voltage as compared with the conventional photoconductor H.

EXAMPLE 4

The advantageous decrease in residual voltage which is exhibited by photoconductors according to the present invention, as demonstrated in Example 1, may also be obtained when lower amounts of charge transport compound are employed in the charge generation layer. In this example, a photoconductor K according to the present invention and comparative photoconductors L and M were prepared. The substrate and charge transport layer of each photoconductor were similar to those described in Example 1 with each charge transport layer comprising 40 weight percent TPD. The charge generation layer of photoconductor K according to the present invention contained approximately 20 weight percent TPD, 30 weight percent type IV TiOpc pigment and 50% polymeric binder. The charge generation layer of the comparative photoconductor L contained no TPD, approximately 37 weight percent type IV TiOpc and 63 weight percent of the polymeric binder, and therefore had the same pigment to binder weight ratio (0.6) as the charge generation layer of photoconductor K. The charge generation layer of the comparative photoconductor M contained no TPD and approximately 30 weight percent type IV TiOpc and 70 weight percent polymeric binder. Photoconductors K and M therefore contained the same total amount of pigment, i.e., 30 weight percent.

Figure 6A:
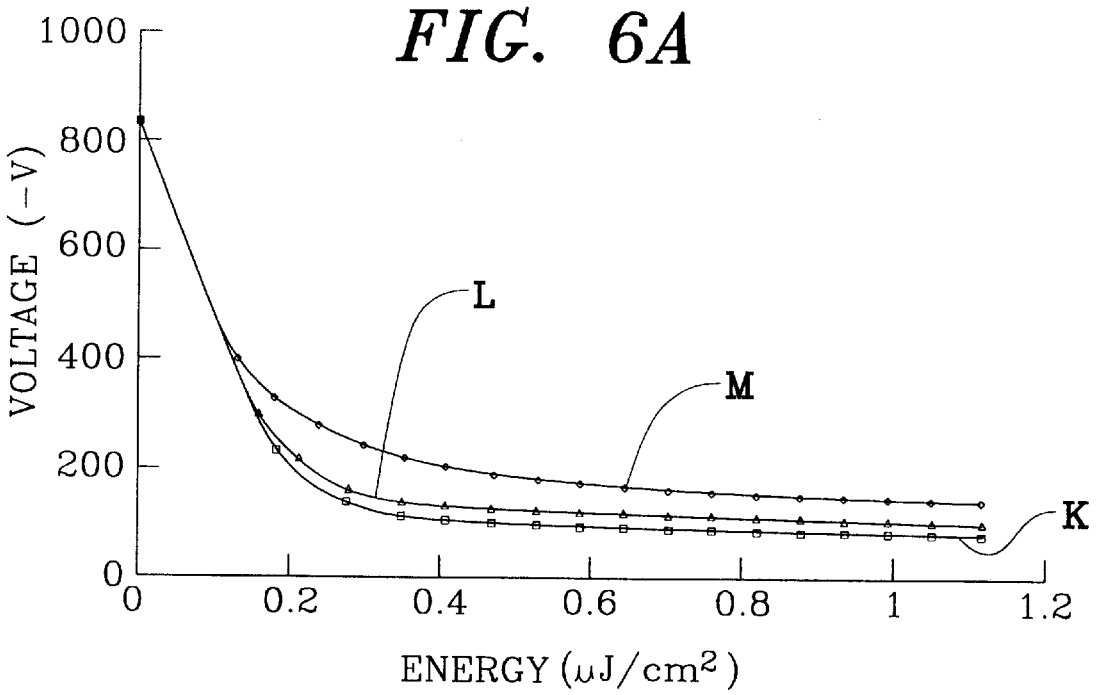
FIGS. 6A and 6B set forth electrical performance properties of a photoconductor K according to the present invention and of comparative photoconductors L and M, as described in Example 4.
Figure 6B:
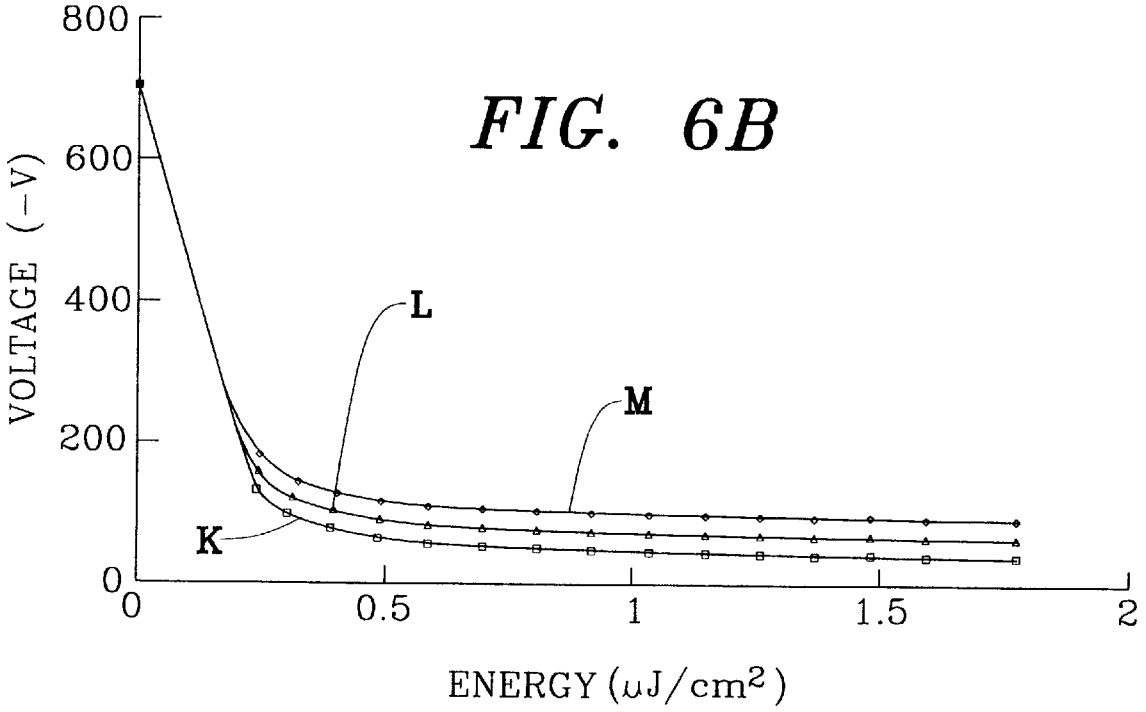

The photoconductors K, L and M were subjected to sensitivity measurements using the general procedures described in Example 1, first using an expose to develop time of 76 ms, the results of which are set forth in FIG. 6A, and second using an expose to develop time of 257 ms, the results of which are set forth in FIG. 6B. In FIGS. 6A and 6B, curves K, L and M represent the performance of photoconductors K, L and M, respectively. FIGS. 6A and 6B demonstrate that the photoconductor K according to the present invention exhibited reduced residual voltage as compared with the comparative photoconductors L and M.

EXAMPLE 5

This example demonstrates the benefits which may be obtained when the charge generation layer is formed from a dispersion wherein the charge generation compound and the charge transport compound are comilled or comixed in a milling solvent in the absence of any polymeric binder, followed by milling in the presence of the polymeric binder. The substrates and charge transport layers of the photoconductors described in this example were similar to those of Example 1, with the charge transport layers comprising approximately 30 weight percent TPD.

The charge generation layer of photoconductor N of his example was prepared as follows. Type IV TiOpc pigment was slurried (12 weight percent solids) with a solvent comprising a 20:80 mixture of methyl ethyl ketone (MEK) and cyclohexanone. The slurry was milled for a residence time of approximately 15 minutes, after which TPD was added and the resulting slurry was then stirred for two hours. After this milling and stirring, a binder solution comprising approximately 12 weight percent polyvinylbutyral (PVB) in a 62:38 mixture of MEK and cyclohexanone was added, resulting in a mill base comprising 19.2% solids (39% TiOpc pigment, 43% TPD and 18% PVB, by weight) and 80.8% solvent (MEK:cyclohexanone in a 1:2 ratio). Milling was then conducted for approximately two additional hours. A final dispersion was prepared by diluting the mill base with a very dilute solution of PVB binder in MEK. The final dispersion composition comprised 4.4% solids (33% TPD, 30% TiOpc pigment and 37% binder, by weight) in a 90:10 MEK:cyclohexanone solvent. The photoconductor N was prepared using this final dispersion to form the charge generation layer.

A similar photoconductor O was prepared using a one step milling technique for the charge generation layer. Specifically, a mill base of 1 6% solids (68% TiOpc and 32% PVB) and a 16.25:83.75 MEK:cyclohexanone solvent mixture was premixed with a mechanical stirrer for four hours and then milled for a residence time of two hours. A final dispersion was prepared by diluting the mill base with a very dilute solution of the PVB binder in MEK and cyclohexanone to achieve a dispersion composition with solids comprising 45 weight percent TiOpc and 55 weight percent PVB in a 90:10 MEK:cyclohexanone solvent mixture. TPD was then added to the dispersion to provide a solids content comprising 33% TPD. 30% TiOpc and 37% binder, by weight. The dispersion was applied to form the charge generation layer of the photoconductor O.

Figure 7A:
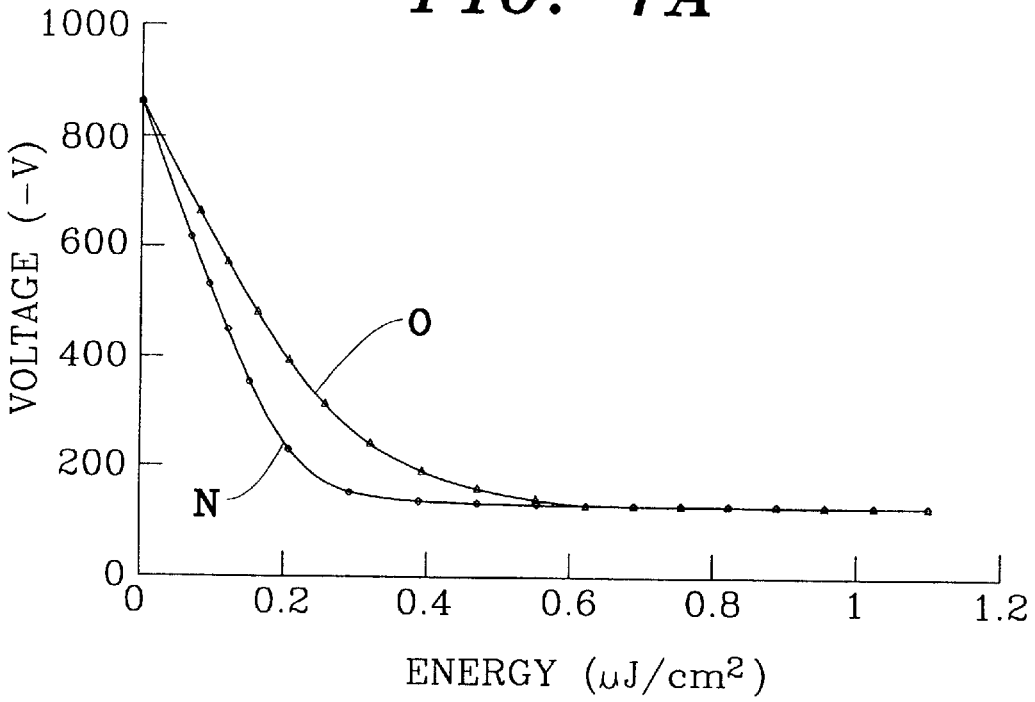
FIGS. 7A and 7B set forth electrical performance properties of photoconductors N and O according to the invention, as described in Example 5.
Figure 7B:
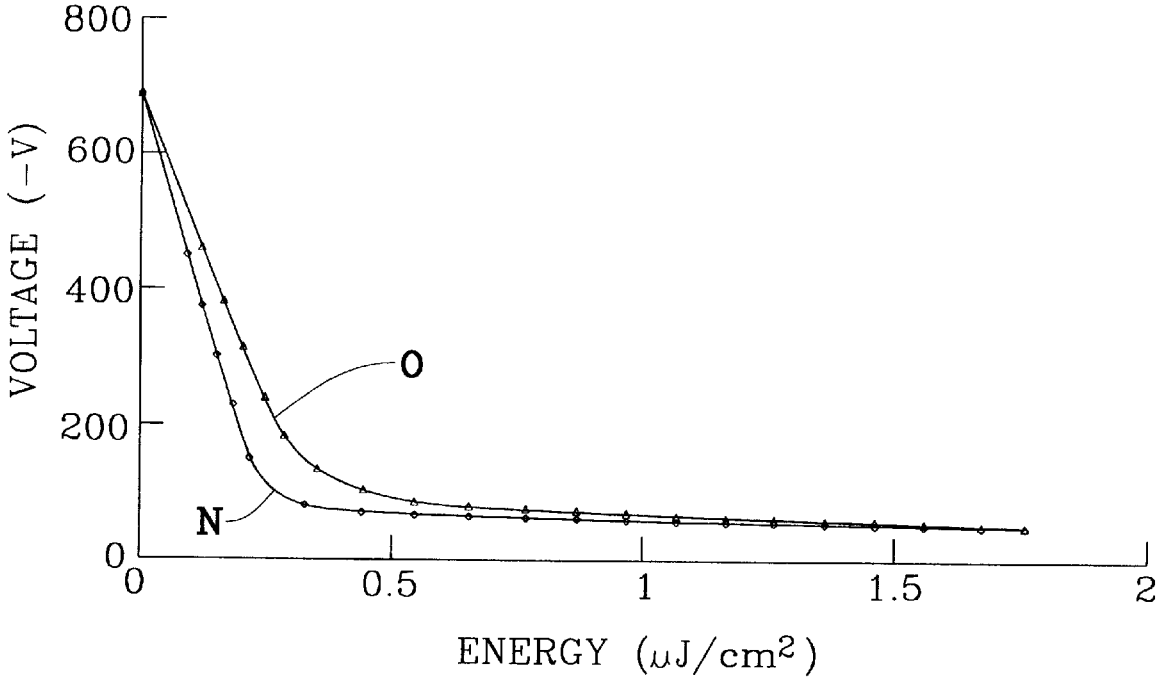

The photoconductors N and O were subjected to sensitivity measurements as described in Example 1, first using an expose to develop time of 76 ms, the results of which are set forth in FIG. 7A, and second using an expose to develop time of 257 ms, the results of which are set forth in FIG. 7B. In FIGS. 7A and 7B, curves N and O represent the performances of photoconductors N and O, respectively. The results set forth in FIG. 7A and 7B demonstrate that while both of photoconductors N and O exhibited reduced residual voltage, the photoconductor N exhibited improved sensitivity as compared with the photoconductor O as evidenced by the steeper slope of the N curves in the low energy region.

EXAMPLE 6

This example further demonstrates the improvement exhibited by photoconductors wherein the charge generation layer contains a charge transport compound which is different from the charge transport compound of the charge transport layer.

More particularly, a photoconductor P according to the present invention was prepared in a manner as described in Example 1, with the charge transport layer comprising 40 weight percent of the charge transport compound DEH. The charge generation layer was formed from a dispersion prepared according to the two-step process described in Example 5 and comprised 33% TPD, 30% TiOpc and 37% polymeric binder, by weight. For comparison purposes, a comparative photoconductor Q was prepared and included a charge transport layer comprising 40 weight percent DEH and a charge generation layer comprising TiOpc pigment and polymeric binder, in the absence of TPD.

Figure 8A:
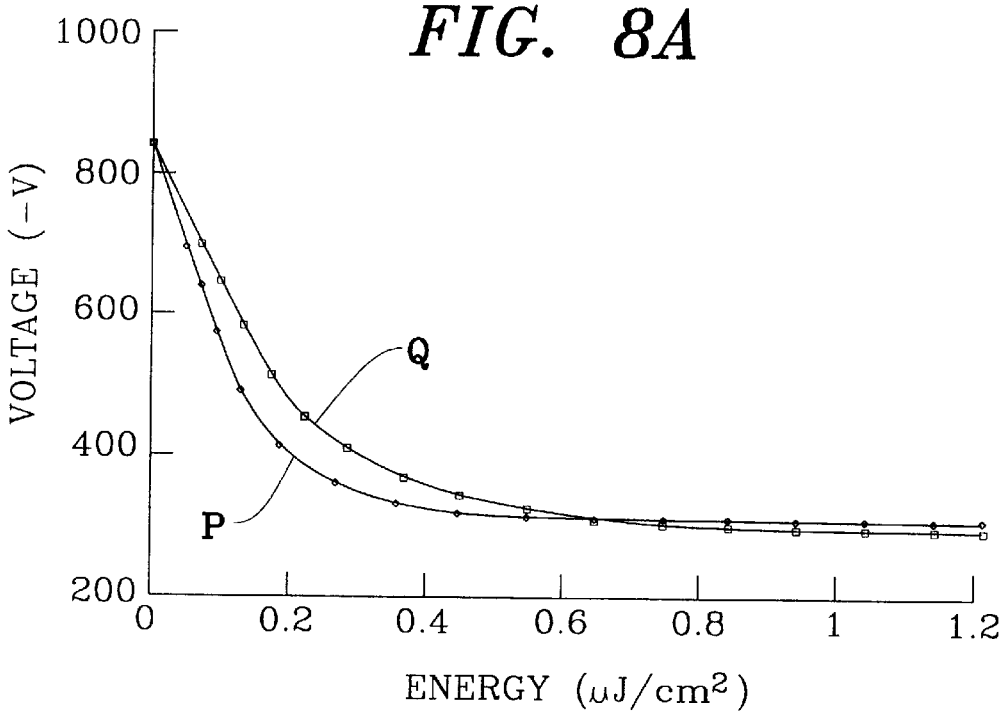
FIGS. 8A and 8B set forth electrical performance properties of a photoconductor P according to the invention and of a comparative photoconductor Q, as described in Example 6.
Figure 8B:
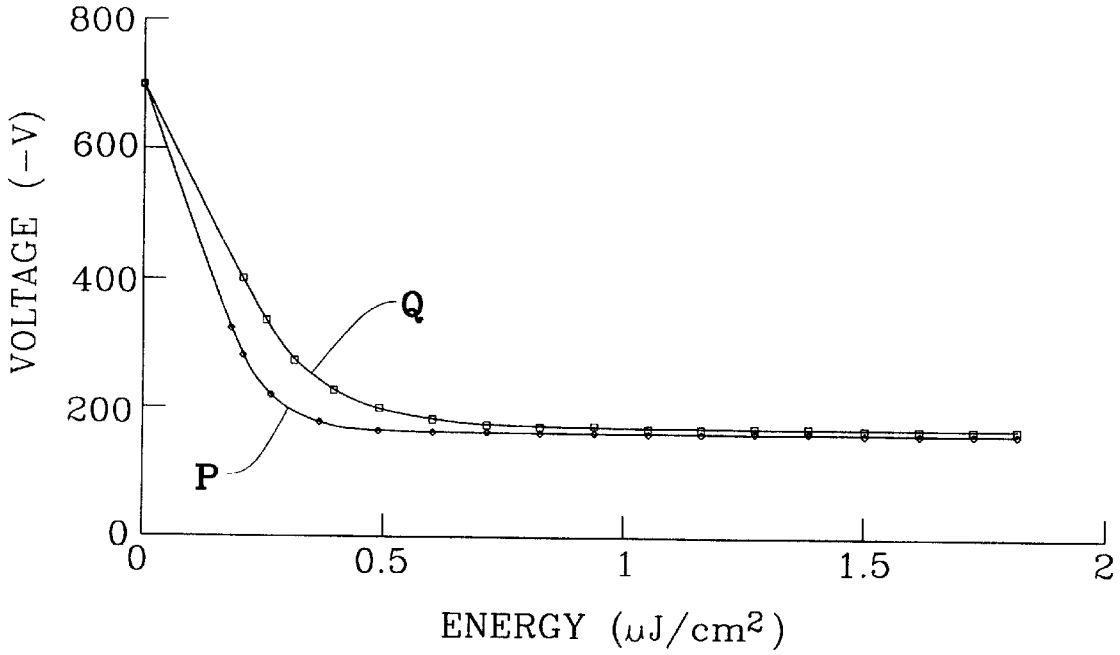

Photoconductors P and Q were subjected to sensitivity measurements in accordance with the procedures set forth in Example 1, first using an expose to develop time of 76 ms, the results of which are set forth in FIG. 8A, and second using an expose to develop time of 257 ms, the results of which are set forth in FIG. 8B. In FIGS. 8A and 8B, curves P and Q represent the performances of photoconductors P and Q, respectively. The results set forth in FIGS. 8A and 8B demonstrate that further improved photoconductor sensitivity is obtained when different charge transport compounds are employed in the charge transport layer and the charge generation layer, respectively.

While the inventors do not intend to be limited by any one theory, it is believed that during the coating of the charge transport layer over the charge generation layer in a photoconductor such as photoconductor P according to the invention described in Example 6, a portion of the TPD charge transport compound contained in the charge generation layer diffuses into the charge transport layer and conversely some of the DEH charge transport compound contained in the charge transport layer diffuses into the charge generation layer. It is therefore surprising that this intermixing occurring at the interface of the charge generation layer and the charge transport layer does not result in trapping and a decrease in the sensitivity of the photoconductor. Rather, as demonstrated above, the sensitivity of the photoconductor is increased, particularly when the charge transport compound contained in the charge generation layer has been premilled with the charge generation compound in the absence of polymeric binder. The use of TPD as the charge transport compound in the charge generation layer, in combination with the use of DEH as the charge transport compound in the transport layer, provides both cost advantages and improved wear as compared with a conventional photoconductor comprising a standard charge generation layer overcoated with a TPD-containing charge transport layer and exhibits improved sensitivity as compared with such layers and with standard charge generation layers overcoated with a DEH-containing charge transport layer.

EXAMPLE 7

Advantageous decreases in residual voltage were demonstrated by the photoconductors according to the present invention in Examples 1 and 4. Dramatic decreases in residual voltage have also been obtained when relatively low pigment concentrations are employed in the charge generation layer.

In this example, a photoconductor R according to the invention was prepared with a substrate and a charge transport layer as described in Example 5. The charge generation layer was prepared from a disperson comprising 20 weight percent pigment (titanyl phthalocyanine type IV), 47 weight percent binder and 33 weight percent TPD at 4.6% solids in a 90:10 parts by weight methyl ethyl keton:cyclohexanone solvent mixture. The dispersion was prepared using the two step milling procedure described in Example 5. A comparative photoconductor S was prepared with a similar substrate and charge transport layer and with a charge generation layer prepared from a dispersion comprising 20 weight percent pigment (titanyl phthalocyanine type IV) and 80 weight percent binder at 4.6% solids in a 90:10 parts by weight methyl ethyl ketone:cyclohexanone solvent mixture.

Figure 9:
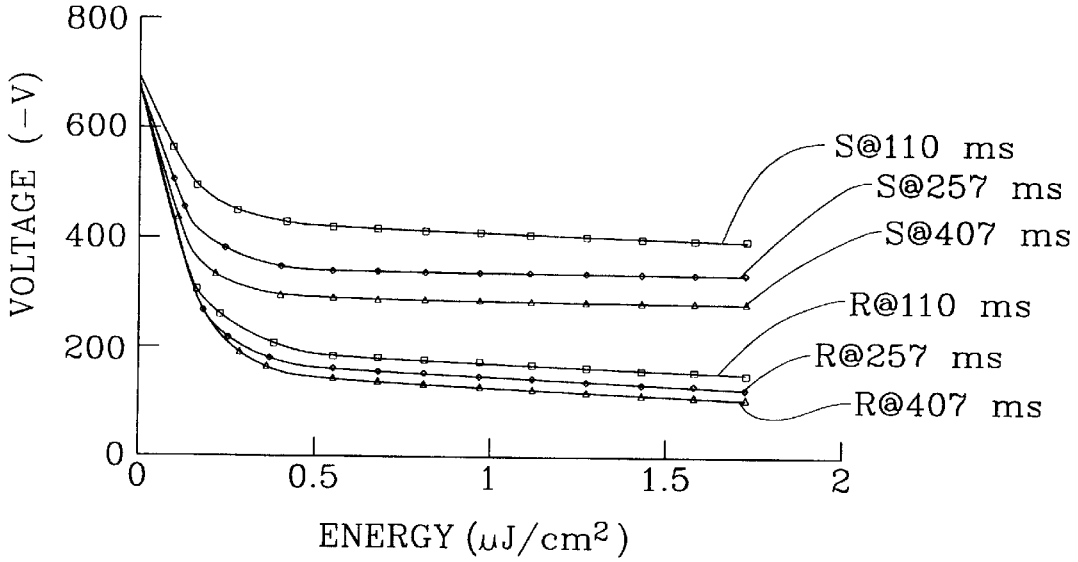
FIG. 9 sets forth electrical performance properties of a photoconductor R according to the invention and a comparative photoconductor S at various expose to develop times, as described in Example 7.

Photoconductors R and S were subjected to sensitivity measurements in accordance with the procedures set forth in Example 1, first using an expose to develop time of 110 ms, second using an expose to develop time of 257 ms, and third using an expose to develop time of 407 ms. The results of the sensitivity measurements are set forth in FIG. 9. As demonstrated in FIG. 9, significant reductions in residual voltage were obtained with photoconductor R according to the present invention. The most dramatic effect was shown at the expose to develop time of 110 ms, with a decrease of approximately 242 V.

The foregoing examples and various preferred embodiments of the present invention set forth herein are provided for illustrative purposes only and are not intended to limit the scope of the invention defined by the claims. Additional embodiments of the present invention and advantages thereof will be apparent to one of ordinary skill in the art and are within the scope of the invention defined by the following claims.

We claim:

1. A dual layer photoconductor comprising a substrate, a charge transport layer, and a charge generation layer, wherein the charge transport layer comprises binder and a first charge transport compound, and the charge generation layer comprises binder, a charge generation compound and a second charge transport compound, wherein the first and second charge transport compounds may be the same or different, the second charge transport compound is a dopant in the charge generation layer, and the weight ratio of the charge generation compound to the second charge transport compound in the charge generation layer is not less than about 1:3.

2. A photoconductor as defined by claim 1, wherein the weight ratio of the charge generation compound to the second charge transport compound in the charge generation layer is not less than about 1:2.

3. A photoconductor as defined by claim 1, wherein the charge generation compound comprises a phthalocyanine.

4. A photoconductor as defined by claim 1, wherein the charge generation layer comprises at least about 10 weight percent, based on the weight of the charge generation layer, of the charge generation compound.

5. A photoconductor as defined by claim 1, wherein the first and second charge transport compounds are different.

6. A photoconductor as defined by claim 1, wherein the first and second charge transport compounds are the same.

7. A photoconductor as defined by claim 5, wherein the first charge transport compound has an oxidation potential less than an oxidation potential of the second charge transport compound.

8. A photoconductor as defined by claim 5, wherein the first and second charge transport compounds individually comprise hydrazones, aromatic amines or substituted aromatic amines, or mixtures thereof.

9. A dual layer photoconductor comprising a substrate, a charge generation layer formed on the substrate, and a charge transport layer formed on the charge generation layer, wherein the charge transport layer comprises binder and a first charge transport compound, and the charge generation layer comprises binder a charge generation compound, and a second charge transport compound, wherein the first and second charge transport compounds are different and the first charge transport compound has an oxidation potential that is less than an oxidation potential of the second charge transport compound or that is not more than 0.2 V greater than an oxidation potential of the second charge transport compound.

10. A photoconductor as defined by claim 9, wherein the first charge transport compound oxidation potential is less than the second charge transport compound oxidation potential.

11. A photoconductor as defined by claim 9, wherein the first charge transport compound oxidation potential is at least about 0.1 V less than the second charge transport compound oxidation potential.

12. A photoconductor as defined by claim 9, wherein the first charge transport compound and the second charge transport compound are the same.

13. A photoconductor as defined by claim 9, wherein the charge generation compound comprises a metal phthalocyanine and the first and second charge transport compounds individually comprise hydrazones, aromatic amines or substituted aromatic amines, or mixtures thereof.

14. A photoconductor as defined by claim 9, wherein the charge generation layer comprises at least about 10 weight percent, based on the weight of the charge generation layer, of the charge generation compound.

15. A dual layer photoconductor comprising a substrate, a charge transport layer, and a charge generation layer, wherein the charge transport layer comprises binder and a first charge transport compound, and the charge generation layer comprises binder, at least about 15 weight percent, based on the weight of the charge generation layer, of a charge generation compound, and a second charge transport compound.

16. A photoconductor as defined by claim 15, wherein the weight ratio of the charge generation compound to the second charge transport compound in the charge generation layer is not less than about 1:3.

17. A photoconductor as defined by claim 15, wherein the charge generation compound comprises a metal phthalocyanine.

18. A photoconductor as defined by claim 15, wherein the first and second charge transport compounds are different.

19. A photoconductor as defined by claim 18, wherein the first charge transport compound has an oxidation potential that is less than an oxidation potential of the second charge transport compound or that is not more than 0.2 V greater than an oxidation potential of the second charge transport compound.

20. A photoconductor as defined by claim 15, wherein the first charge transport compound and the second charge transport compound are the same.

21. A photoconductor as defined by claim 18, wherein the first and second charge transport compounds individually comprise hydrazones, aromatic amines or substituted aromatic amines, or mixtures thereof.

22. A photoconductor as defined by claim 15, wherein the charge generation layer comprises from about 15 to about 50 weight percent of the charge generation compound, from about 10 to about 50 weight percent of the second charge transport compound, and from about 20 to about 75 weight percent of the binder.

* * * * *